US011215085B2

(12) United States Patent
Jakubczak et al.

(10) Patent No.: US 11,215,085 B2
(45) Date of Patent: Jan. 4, 2022

(54) TURBINE EXHAUST DIFFUSER

(71) Applicant: General Electric Comany, Schenectady, NY (US)

(72) Inventors: Przemyslaw Michal Jakubczak, Warsaw (PL); Karol Leszczynski, Cincinnati, OH (US); Robert Jamiolkowski, Warsaw (PL)

(73) Assignee: General Electric Company, Schenectady, NY (US)

( * ) Notice: Subject to any disclaimer, the term of this patent is extended or adjusted under 35 U.S.C. 154(b) by 164 days.

(21) Appl. No.: 16/029,708

(22) Filed: Jul. 9, 2018

(65) Prior Publication Data

US 2019/0048745 A1 Feb. 14, 2019

(30) Foreign Application Priority Data

Aug. 11, 2017 (EP) ..... 17461583

(51) Int. Cl.
*F01D 25/30* (2006.01)
*F01D 25/24* (2006.01)
*F01D 11/00* (2006.01)

(52) U.S. Cl.
CPC ..... *F01D 25/30* (2013.01); *F01D 11/005* (2013.01); *F01D 25/24* (2013.01); *F05D 2220/32* (2013.01); *F05D 2240/12* (2013.01); *F05D 2240/55* (2013.01)

(58) Field of Classification Search
CPC ..... F01D 25/24; F01D 25/30; F01D 11/00; F01D 11/005; F05D 2220/32; F05D 2240/12; F05D 2240/55–2240/57
See application file for complete search history.

(56) References Cited

U.S. PATENT DOCUMENTS

| | | | | |
|---|---|---|---|---|
| 5,104,286 | A | 4/1992 | Donlan | |
| 6,065,756 | A | 5/2000 | Eignor et al. | |
| 2011/0005234 | A1* | 1/2011 | Hashimoto | F01D 25/30 60/796 |
| 2016/0032781 | A1* | 2/2016 | Whitty | F01D 9/04 415/110 |
| 2016/0102578 | A1* | 4/2016 | Leszczynski | F16J 15/3268 415/214.1 |

FOREIGN PATENT DOCUMENTS

| | | | |
|---|---|---|---|
| EP | 0 589 215 | A1 | 3/1994 |
| WO | 2014/068355 | A1 | 5/2014 |

OTHER PUBLICATIONS

Extended European Search Report and Opinion issued in connection with corresponding EP Application No. 17461583.1 dated Jan. 29, 2018.

* cited by examiner

*Primary Examiner* — David Hamaoui
*Assistant Examiner* — Jesse M Prager
(74) *Attorney, Agent, or Firm* — Dority & Manning, P.A.

(57) ABSTRACT

The present application provides an exhaust diffuser. The exhaust diffuser may include an outer diffuser section with a forward portion. An outer forward seal system may be positioned on the forward portion. The outer forward seal system may include a seal base removably positioned in a seal pocket.

13 Claims, 1 Drawing Sheet

TURBINE EXHAUST DIFFUSER

TECHNICAL FIELD

The present application and the resultant patent relate generally to gas turbine engines and more particularly to gas turbine engines with improved exhaust diffusers and diffuser seals configured to reduce out of round conditions.

BACKGROUND OF THE INVENTION

Gas turbine engines generally include an exhaust diffuser positioned downstream of the last stage of a turbine. Generally described, the exhaust diffuser converts the kinetic energy of the hot combustion gases exiting the last stage of the turbine into potential energy in the form of increased static pressure. The exhaust diffuser directs the hot combustion gases through a casing of increasing cross-sectional area in the direction of the flow. The exhaust diffuser generally includes a number of struts mounted onto a hub and enclosed by the casing.

Typical exhaust diffusers may be a continuous 360 degree circle or split into a number of segments in some fashion. The continuous diffuser may be the easiest to manufacture but a split diffuser may offer more operational flexibility including access to certain components in the field such as bearings and the like. The split diffusers, however, may use tall radial flanges for sealing and/or attachment purposes. These tall flanges may experience stresses and thermal gradients along the length thereof that may result in a high out of round effect. An out of round condition in close proximity to the turbine exit may affect the overall aero-performance and gas turbine output and efficiency.

SUMMARY OF THE INVENTION

The present application and the resulting patent thus provide an exhaust diffuser for a turbine. The exhaust diffuser may include an outer diffuser section with a forward portion. An outer forward seal system may be positioned on the forward portion. The outer forward seal system may include a seal base removably positioned in a seal pocket.

The present application and the resulting patent further provide a method of operating an exhaust diffuser to limit out of round conditions. The method may include the steps of positioning a seal base in a seal pocket of a forward portion of the exhaust diffuser, locking the seal base into place via a channel extending through the forward portion from a flow side thereof, and flowing combustion gases past the forward portion on the flow side thereof.

The present application and the resultant patent further provide an exhaust diffuser. The exhaust diffuser may include an outer diffuser section with a forward portion. An outer forward seal system may be positioned on the forward portion. The outer forward seal system may include a seal base with a seal member and a seal pocket formed within the forward portion. The seal member may be removably positioned therein and secured via a dowel extending through the forward portion.

These and other features and improvements of the present application and the resultant patent will become apparent to one of ordinary skill in the art upon review of the following detailed description when taken in conjunction with the several drawings and the appended claims.

BRIEF DESCRIPTION OF THE DRAWINGS

Reference will now be made to the accompanying drawings, which are not necessarily drawn to scale, and wherein.

DETAILED DESCRIPTION

Figure 1:
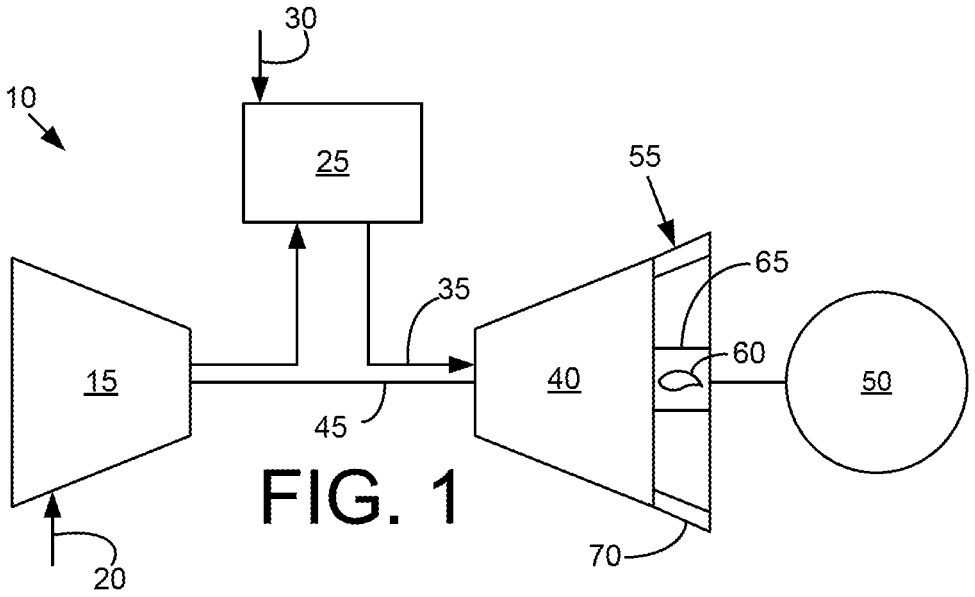
FIG. 1 is a schematic diagram of a gas turbine engine with a compressor, a combustor, a turbine, an exhaust diffuser, and a load.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25 configured in a circumferential array and the like. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, liquid fuels, and/or other types of fuels and blends thereof. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
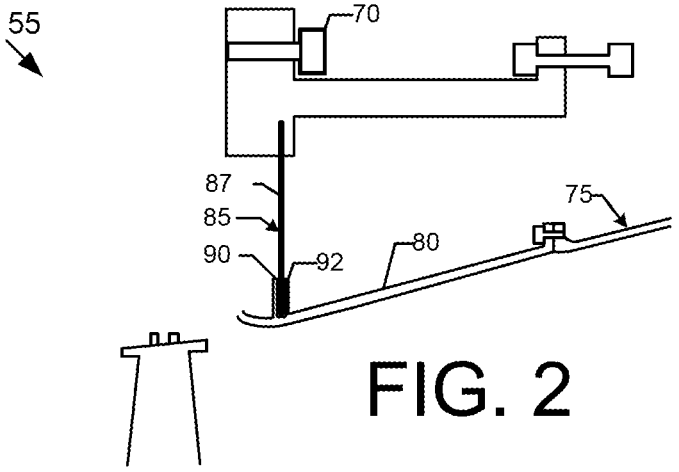
FIG. 2 is a sectional view of a portion of an exhaust diffuser of the gas turbine engine of FIG. 1.

As is shown in FIGS. 1 and 2, the gas turbine engine 10 also may include an exhaust diffuser 55. The exhaust diffuser 55 may be positioned downstream of and in communication with the turbine 40. As described above, the exhaust diffuser 55 may include a number of struts 60 mounted on a hub 65 and enclosed within an outer casing 70. The struts 50 serve to hold the hub 65 and the casing 70 in a fixed relationship to one another. The exhaust diffuser 55 may turn the flow of the combustion gases 35 in a radial direction.

The exhaust diffuser 55 may include an outer diffuser section 75 attached to the casing 70 so as to define a continuous flow path for the hot combustion gasses 35. The outer diffuser section 75 may include a forward portion 80 positioned about the exit of the turbine 40. The forward portion 80 may include an outer forward seal 85 extending towards the casing 70. The outer forward seal 85 may include a flexible seal member 87. The flexible seal member 87 may be positioned in a radial slot 90 formed by a number of flanges 92 extending from a skin 95 of the forward portion 80 of the outer diffuser section 75. As described above, the exhaust diffuser 55 may experience out of round conditions, particularly about the outer diffuser section 75 given the proximity to the exit of the turbine 40.

Figure 3:
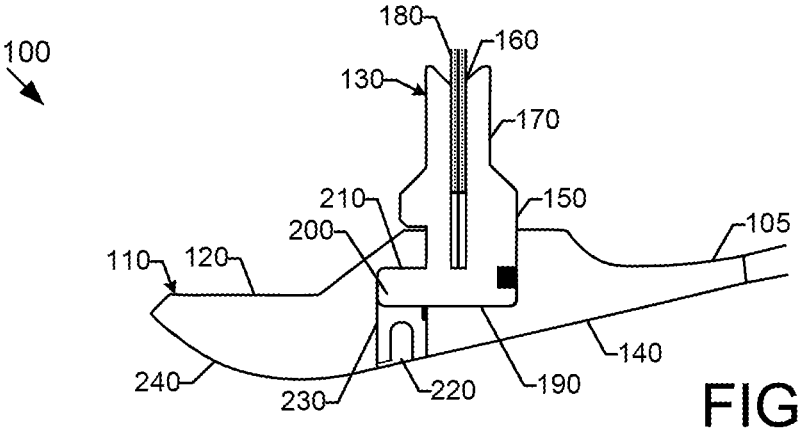
FIG. 3 is a sectional view of an outer forward seal system of an exhaust diffuser as may be described herein.

FIG. 3 shows a portion of an exhaust diffuser 100 as may be described herein. In this example, the exhaust diffuser 100 may be segmented with two or more segments 105. The exhaust diffuser 100 may include an outer diffuser section 110 with a forward portion 120 positioned about the exit of the turbine 40. The outer diffuser section 110 may include an outer forward seal system 130 extending about a skin 140 of the forward portion 120. Instead of the slot 90 formed by the flanges 92 extending from the skin 95 as described above, the exhaust diffuser 100 described herein includes a seal base 150. The seal base 150 may be detachable from the skin 140 of the forward portion 120. The seal base 150 may include a radial slot 160 formed between a pair of flanges 170. A flexible seal member 180 may be positioned and secured within the radial slot 160. The seal base 150 and the components thereof may have any suitable size, shape, or configuration.

The seal base 150 may be positioned in a seal pocket 190 formed within the skin 140 of the forward portion 120. The seal pocket 190 may have any suitable size, shape, or configuration. The seal base 150 may have an axially extending hook 200 that may mate with an axially extending slot 210 within the seal pocket 190 (or vice versa). The forward portion 120 may have a channel 230 extending therein opening on a flow side 240 thereof and extending to the seal pocket 190. The seal base 150 may be secured in place via a dowel 220 extending through the channel 230 of the forward portion 120. Other types of locking mechanisms may be used herein.

In use, the seal base 150 may be positioned within the seal pocket 190 and secured via the dowel 220 extending through the channel 230 from the flow side 240 of the forward portion 120. The mating of the axially extending hook 200 the seal base 150 and the axially extending slot 210 of the seal pocket 190 effectively locks the seal base 150 into position both radially and axially but largely decoupled in the hoop direction. The outer forward seal system 130 thus effectively reduces the radial height of the forward portion 120 so as to reduce the radial stiffness of the overall exhaust diffuser 100. As a result, overall out of round conditions may be reduced while maintaining good sealing effectiveness.

The exhaust diffuser 100 described herein thus splits the sealing function and the flow path forming function. Such a split may allow large relative deflection compensation between the static frame and the thermally growing exhaust diffuser 100. Specifically, the outer forward seal system 130 may minimized out of round conditions with reduced stress on the skin 140 of the forward portion 120 while maintaining good seal efficiency. The exhaust diffuser 100 with the outer forward seal system 130 thus provides good sealing performance such that a smaller blower may be used to provide cooling/sealing air. Moreover, an improved circular shape given a reduction in out of round conditions may provide improved diffuser performance at the turbine exit with smaller separation in high flow conditions. The lower profile of the exhaust diffuser 100 also may create reduced stresses for a more robust performance with a reduction in maintenance.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

The invention claimed is:

1. An exhaust diffuser, comprising:

an outer diffuser section, the outer diffuser section comprising a forward portion disposed about an exit end of a turbine, the forward portion including a flow side and a seal side and extending between a free end and a connected end, the forward portion defining a seal pocket between the free end and the connected end on the seal side, the seal pocket having a radially extending portion and an axially extending portion extending directly from the radially extending portion; and an outer forward seal system positioned within the forward portion;

wherein the outer forward seal system comprises a seal base removably positioned in the seal pocket, the seal base comprising a body installed in the radially extending portion, a pair of flanges extending radially outward from the body, and a hook installed in the axially extending portion, wherein the body and the pair of flanges define a radial slot, and wherein the hook extends axially from the body and axially beyond the body.

2. The exhaust diffuser of claim 1, wherein the seal base comprises a seal member positioned within the radial slot.

3. The exhaust diffuser of claim 2, wherein the seal member extends towards a casing.

4. The exhaust diffuser of claim 2, wherein the seal member comprises a flexible seal.

5. The exhaust diffuser of claim 1, wherein the forward portion comprises a channel therein extending radially outward from the flow side and extending to the axially extending portion of the seal pocket.

6. The exhaust diffuser of claim 5, wherein the forward portion comprises a dowel removably positioned within the channel and extending into the axially extending portion.

7. The exhaust diffuser of claim 1, wherein the forward portion comprises a skin facing a flow of combustion gases.

8. The exhaust diffuser of claim 7, wherein the seal base is positioned on the seal side of the forward portion opposite of the skin facing the flow of combustion gases such that the seal base forms no portion of the skin.

9. The exhaust diffuser of claim 1, wherein the exhaust diffuser comprises a plurality of segments.

10. A method of operating an exhaust diffuser, the exhaust diffuser comprising a forward portion being disposed about an exit end of a turbine, the forward portion including a flow side and a seal side and extending between a free end and a connected end, the method comprising:

removably positioning a hook of a seal base in an axially extending portion of a seal pocket of the forward portion of the exhaust diffuser and a body of a seal base in a radially extending portion of the seal pocket, the seal pocket being defined in the forward portion between the free end and the connected end on the seal side, wherein the hook extends axially from the body and axially beyond the body, wherein the seal base comprises a pair of flanges defining a radial slot, the pair of flanges extending radially outward from the body of the seal base, and wherein the body of the seal base partially defines the radial slot;

locking the seal base into place by extending a dowel into a channel extending through the forward portion from the flow side thereof; and flowing combustion gases past the forward portion on the flow side thereof.

11. An exhaust diffuser, comprising:

an outer diffuser section, the outer diffuser section comprising a forward portion disposed about an exit end of a turbine, the forward portion including a flow side and a seal side and extending between a free end and a connected end, the forward portion defining a seal pocket between the free end and the connected end on the seal side, the seal pocket having an axially extending portion; and an outer forward seal system positioned on the forward portion, the outer forward seal system comprising:

a seal base with a seal member, the seal base having a hook, a pair of flanges, and a body, the hook extending axially from the body and axially beyond the body, the hook configured for installation in the axially extending portion of the seal pocket, the pair of flanges extending radially outward from the body, and the body and the pair of flanges defining a radial slot;

wherein the seal base forms no portion of the flow side, and wherein the seal base is removably positioned within the axially extending portion of the seal pocket and is secured via a dowel extending through the forward portion.

12. The exhaust diffuser of claim 11, wherein the forward portion comprises a channel therein extending radially outward from the flow side and extending to the axially extending portion of the seal pocket; and wherein the dowel is removably positioned within the channel and extends from the flow side to the hook.

13. The exhaust diffuser of claim 12, wherein the dowel terminates radially at the hook.

* * * * *